US011919691B2

(12) United States Patent
Schuberth et al.

(10) Patent No.: US 11,919,691 B2
(45) Date of Patent: Mar. 5, 2024

(54) FLEXIBLE CARRYING CASE

(71) Applicant: AMCOR FLEXIBLES NORTH AMERICA, INC., Neenah, WI (US)

(72) Inventors: Jamie L. Schuberth, Madison, WI (US); Jay D. Hodson, Hortonville, WI (US); Jeffrey J. Smits, Omro, WI (US)

(73) Assignee: AMCOR FLEXIBLES NORTH AMERICA, INC., Neenah, WI (US)

( * ) Notice: Subject to any disclaimer, the term of this patent is extended or adjusted under 35 U.S.C. 154(b) by 501 days.

(21) Appl. No.: 17/274,714

(22) PCT Filed: Sep. 12, 2018

(86) PCT No.: PCT/US2018/050604

§ 371 (c)(1),
(2) Date: Mar. 9, 2021

(87) PCT Pub. No.: WO2020/055392

PCT Pub. Date: Mar. 19, 2020

(65) Prior Publication Data

US 2022/0048686 A1 Feb. 17, 2022

(51) Int. Cl.

| | |
|---|---|
| ***B65D 33/08*** | (2006.01) |
| ***B65D 30/20*** | (2006.01) |
| ***B65D 33/18*** | (2006.01) |
| ***B65D 71/08*** | (2006.01) |
| ***B65D 71/36*** | (2006.01) |
| ***B65D 75/00*** | (2006.01) |

(52) U.S. Cl.

CPC ..... *B65D 71/36* (2013.01); *B65D 31/10* (2013.01); *B65D 33/08* (2013.01); *B65D 33/18* (2013.01); *B65D 71/08* (2013.01); *B65D 75/002* (2013.01); *B65D 2571/00141* (2013.01); *B65D 2571/0045* (2013.01); *B65D 2571/00679* (2013.01); *B65D 2571/00728* (2013.01)

(58) Field of Classification Search

CPC ..... B65D 71/36; B65D 31/10; B65D 33/08; B65D 33/18; B65D 71/08; B65D 75/002; B65D 2571/00728; B65D 2571/00679

USPC ..... 206/139, 432

See application file for complete search history.

(56) References Cited

U.S. PATENT DOCUMENTS

| | | | | |
|---|---|---|---|---|
| 3,087,610 A * | 4/1963 | Kirkpatrick | ..... | B65D 71/08 53/442 |
| 3,355,303 A * | 11/1967 | Meyers | ..... | B65D 75/002 383/106 |
| 3,681,891 A | 8/1972 | Reinhold | | |

(Continued)

FOREIGN PATENT DOCUMENTS

| | | | | |
|---|---|---|---|---|
| FR | 2418169 A1 | 9/1979 | | |
| WO | WO-2015120158 A1 * | 8/2015 | ..... | B65D 31/04 |

*Primary Examiner* — Rafael A Ortiz

(57) ABSTRACT

A thermoplastic flexible package includes a first non-shrinkable panel, an opposing second non-shrinkable panel, a first shrinkable panel and an opposing a second shrinkable panel. The panels are connected longitudinally with panel seals. The first non-shrinkable panel and the second non-shrinkable panel each forms a gusset. A first seal connects the first shrinkable panel and the second shrinkable panel in the transverse direction at or near the upper edges. A second seal that opposes the first seal connects the first and second non-shrinkable panels and the first and shrinkable panels in the transverse direction at or near the lower edges.

13 Claims, 7 Drawing Sheets

(56) References Cited

U.S. PATENT DOCUMENTS

| | | | | |
|---|---|---|---|---|
| 4,491,959 | A | 1/1985 | Loefberg | |
| 4,966,286 | A | 10/1990 | Muckenfuhs | |
| 5,074,675 | A * | 12/1991 | Osgood | B65D 31/02 383/122 |
| 5,163,558 | A | 11/1992 | Palumbo et al. | |
| 2007/0261982 | A1 | 11/2007 | Gardner | |
| 2013/0008824 | A1 | 1/2013 | Ito et al. | |
| 2014/0131248 | A1 | 5/2014 | Komatsubara et al. | |
| 2015/0056354 | A1 * | 2/2015 | Blucher | B65D 77/20 220/573.1 |
| 2015/0093050 | A1 * | 4/2015 | Bunton | B65D 33/08 383/7 |
| 2016/0137378 | A1 * | 5/2016 | Kruse | B65D 33/2508 493/215 |

* cited by examiner

FLEXIBLE CARRYING CASE

TECHNICAL FIELD

The present disclosure relates to a thermoplastic flexible package that can be used to carry items.

BACKGROUND

Articles such as food, healthcare, personal care, office, home and garden supplies, etc. can be held within paper-based containers or paperboard cartons. The articles may be contained within a smaller package that may be contained in the paper-based containers or paperboard cartons. For example, some food items such as beverages can be contained in rigid or semi-rigid plastic bottles. Several of the bottles may be placed onto a paper-based or corrugated tray that is then shrink-wrapped with plastic film. In another example, beverages can be contained in cans. Several of the is cans may be placed into a paperboard carton.

The shrink-wrapped paper-based tray and the paperboard carton packaging formats allow for display on a store shelf and for transport of smaller items. However, there are drawbacks to each of these paper-based packaging formats. The shrink-wrapped paper-based tray may have distorted graphics due to uneven shrinkage of the shrink film around the tray where the package is unaesthetically pleasing and/or makes it difficult for the user to read information on the package. Further, the shrink-wrapped paper-based tray may be difficult fora user to carry as the edges of the shrink-wrapped film are not designed to accommodate user's hands or may tear while the user is carrying the package.

Drawbacks related to paperboard cartons include interrupted graphics due to misalignment of the various folds and edges of the carton that may also be unaesthetically pleasing and/or makes it difficult for the user to read information on the package. The paperboard cartons may also tear when being carried by a user. Further, paperboard cartons that contain beverage cans are commonly used in outdoor environments and/or in situations where ice is present to keep the beverages cold. The paperboard cartons do not withstand moisture well and can also tear unexpectedly and allows the cans to spill out of the carton when not intended.

SUMMARY

There is a need for a flexible package that can be used to display items, can be used to carry items, especially without unintentional tearing, and that can withstand moist environments. The present application describes such a thermoplastic flexible package.

In an aspect, the thermoplastic flexible package includes a first non-shrinkable panel, an opposing second non-shrinkable panel, a first shrinkable panel and an opposing a second shrinkable panel. A panel seal connects each the first non-shrinkable panel to the first shrinkable panel, the first non-shrinkable panel to the second shrinkable panel, the second non-shrinkable panel to the first shrinkable panel and the second non-shrinkable panel to the second shrinkable panel. A first seal connects the first shrinkable panel and the second shrinkable panel. A second seal that is opposite the first seal connects the first and second non-shrinkable panels and the first and shrinkable panels. The first and second non-shrinkable panels and the first and shrinkable panels each include a first longitudinal edge that opposes a second longitudinal edge and each panel includes a first upper transverse edge that opposes a second lower transverse edge.

The first non-shrinkable panel and the second non-shrinkable panel oppose each other such that the first upper transverse edges and the second lower transverse edges correspond with each other. The first shrinkable panel and the second shrinkable panel oppose each other such that the first upper transverse edges and the second lower transverse edges correspond with each other. The panel seals connect the longitudinal edges of the first and second non-shrinkable panels to the first and second shrinkable panels. The first non-shrinkable panel and the second non-shrinkable panel each forms a gusset. The package includes a second seal that includes the second lower edges of the first and second non-shrinkable panels and the first and second shrinkable panels.

Other features that may be used individually or in combination with respect to any aspect of the disclosure are as follows.

The thermoplastic flexible package may include a first handle perimeter in the first shrinkable panel positioned between the first seal and the first upper edge of the first shrinkable panel and a second handle perimeter in the second shrinkable panel that corresponds to the first handle perimeter.

The thermoplastic flexible package may include a first extension and a second extension that each extend longitudinally away from the first seal. The first extension includes a third handle perimeter and the second extension includes a fourth handle perimeter that corresponds to the third handle perimeter. The third handle perimeter and the fourth handle perimeter correspond to the first handle perimeter and the second handle perimeter when the first extension and the second extension are folded at the first seal toward either the first shrinkable panel or the second shrinkable panel.

The thermoplastic flexible package may include that the first extension and the second extension can be attached to either first shrinkable panel or the second shrinkable panel.

The thermoplastic flexible package may include that the first shrinkable panel and the second shrinkable panel include a free shrink value in the range of greater than 5 percent to 20 percent in each the machine direction and the cross direction of the shrinkable panels.

The thermoplastic flexible package may include that the first non-shrinkable panel and the second non-shrinkable panel include a free shrink value in the range of 0 percent to 5 percent in each the machine direction and the cross direction of the non-shrinkable panels.

The thermoplastic flexible package further includes an opening feature on at least one of the first or second non-shrinkable panels. The opening feature may include a first opening portion and a second opening portion.

The thermoplastic flexible package may include that the first non-shrinkable panel and the second non-shrinkable panel are each further sealed to the first shrinkable panel and the second shrinkable panel with a gusset seal. The gusset seal extends from the panel seal towards the first seal at an angle from the panel seal in the range of greater than 0 degrees to less than 90 degrees.

The thermoplastic flexible package may contain at least a beverage can that includes a can height and a can diameter.

The thermoplastic flexible package includes a width of each of the first non-shrinkable panel and the second non-shrinkable panel that includes the can height.

The thermoplastic flexible package includes an after-shrink width of each of the first shrinkable panel and the second shrinkable panel that includes the sum of the can diameters for each can that is placed next to each other in the transverse direction.

The thermoplastic flexible package includes a second seal that may be a pinch bottom seal or a pinch, fold-over and glue seal.

BRIEF DESCRIPTION OF THE DRAWINGS

Other objects and advantages of the present disclosure will become more apparent to those skilled in the art in view of the following description and the accompanying figures.

The figures show some but not all embodiments. The figures are not necessarily to scale. Like numbers used in the figures refer to like components. It will be understood, however, that the use of a number to refer to a component in a given figure is not intended to limit the component in another figure labeled with the same number.

DETAILED DESCRIPTION

The present disclosure relates to a flexible package that is in the form of a bag 10 that can be used for storing and transporting a variety of items. The term "flexible", as used herein, refers to materials which are capable of being flexed or bent, especially repeatedly, such that they are pliant and yieldable in response to externally applied forces. Flexible is substantially opposite in meaning to the terms inflexible, rigid or unyielding.

Figure 1A:
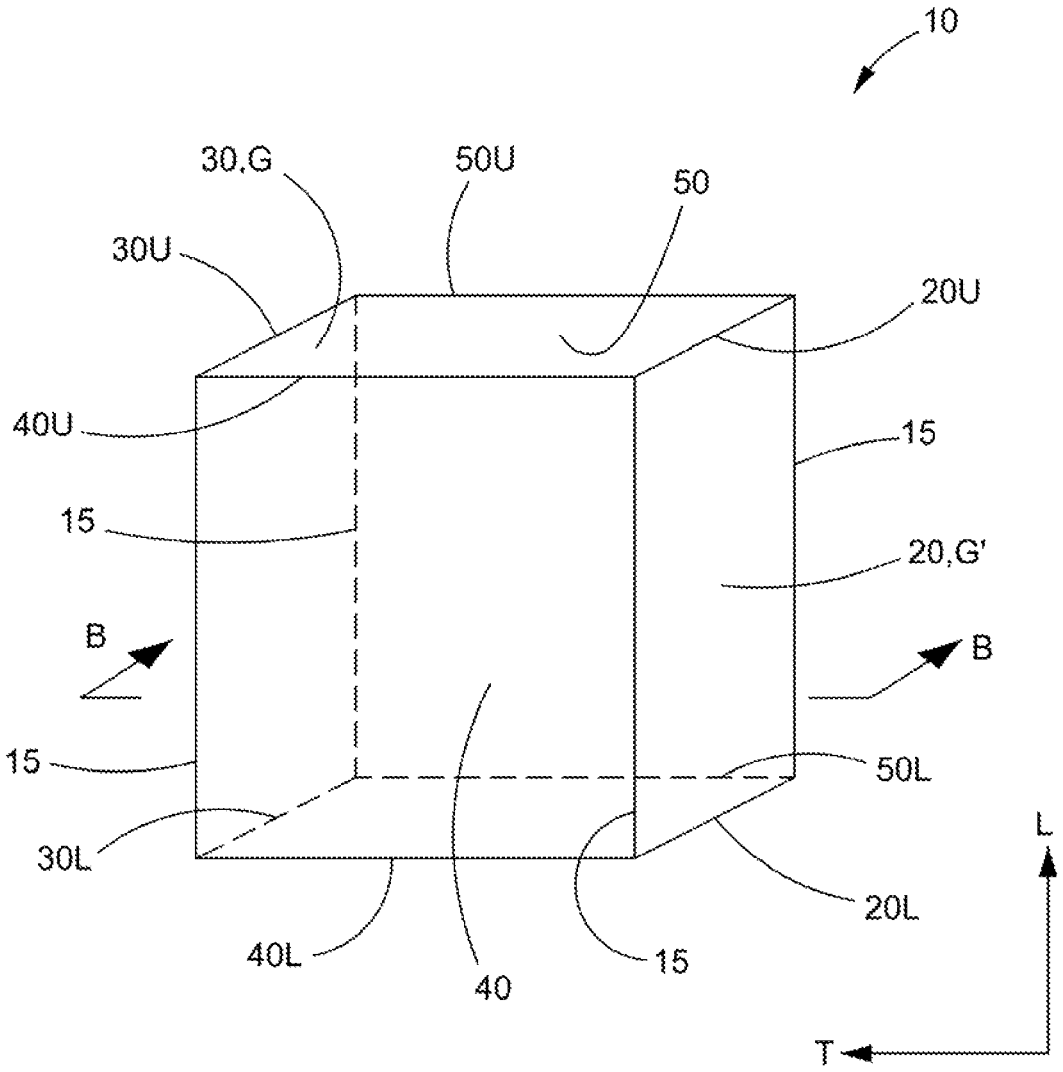
FIG. 1A illustrates a perspective view of an embodiment of the disclosed package.

With reference to FIG. 1A, the bag 10 is includes a first non-shrinkable panel 20, a second non-shrinkable panel 30, a first shrinkable panel 40, and a second shrinkable panel 50 where each panel 20, 30, 40 or 50 includes opposing edges in the longitudinal direction L and opposing edges in the transverse direction T, where each mutual edge is generally parallel to each other. Each panel 20, 30, 40 and 50 includes and first upper transverse edge 20U, 30U, 40U and 50U, and a second lower transverse edge 20L, 30L, 40L and 50L.

The term "panel", as used herein, refers to a single layer or multilayer film.

The term "layer", as used herein, refers to a structure of a single polymer-type or a blend of polymers that may be accompanied by additives and that may be continuous or discontinuous. The layer may be a monolayer or may include sublayers that are subunits of a layer.

The term "film", as used herein, refers to a continuous polymer web of any thickness.

The term "web", as used herein, refers a thermoplastic substrate having one or more structural layers. A "web" may include one or more paper or non-woven structural layers.

The term "multilayer", as used herein, refers to a plurality of layers in a single film generally in the shape of a web that can be made from a polymeric material or a non-polymeric material bonded together by any conventional means known in the art, such as, but not limited to coextrusion, extrusion coating, and lamination, vacuum vapor deposition coating, solvent coating, or suspension coating, or any suitable combination of one or more thereof.

The terms "polymer" or "polymeric", as used herein, refer to a material that is the product of a polymerization reaction of natural, synthetic, or natural and synthetic ingredients, and is inclusive of homopolymers, copolymers, terpolymers, etc. In general, the layers of a film may comprise a single polymer, a mixture of a single polymer and non-polymeric materials, a combination of two or more polymeric materials blended together, or a mixture of a blend of two or more polymeric materials and non-polymeric materials.

The term "thermoplastic", as used herein, refers to a polymer or polymer mixture that softens when exposed to heat and then returns to its original condition when cooled to room temperature. In general, thermoplastic materials may include natural or synthetic polymers. Thermoplastic materials may further include any polymer that is cross-linked by either radiation or chemical reaction during manufacturing or post-manufacturing processes.

The first non-shrinkable panel 20 and the second non-shrinkable panel 30 may be formed from any flexible material that does not have shrinkage or has negligible shrinkage. The term "shrinkage", as used herein, refers to the use of a packaging film manufactured in such a way that when it is exposed to a certain amount of heat, the film will contract in at least one direction along its length or width, preferably in both directions, reducing its overall surface area. Shrinkage values are obtained by measuring unrestrained shrink of a 10 cm square specimen immersed in a water bath. Four test specimens are cut from a given sample of the film to be tested. Specimens are cut into squares of 10 cm in the machine direction (MD) of the film by 10 cm in the transverse direction (TD) of the film. Each specimen is completely immersed for 5 seconds in a 90 degrees Celsius water bath. The specimen is removed from the bath and the distance between the ends of the shrunken specimen is measured for both the MD and TD of the film specimen. The difference in the measured distance for the shrunken specimen and each original 10 cm side is multiplied by ten to obtain the percent of shrinkage for the specimen for each direction. The MD shrinkage for the four specimens is averaged for the MD shrinkage value and the TD shrinkage for the four specimens is averaged for the TD shrinkage value. For the purposes of this disclosure, the term "non-shrinkable" refers to shrinkage of 5 percent or less in either direction, and the term "shrinkable" refers to shrinkage of greater than 5 percent in either direction. For example, the first non-shrinkable panel 20 and the second non-shrinkable panel 30 may have an unrestrained shrinkage value in the MD or the TD in the range of 0 percent to 5 percent, from 1 percent to 4 percent, from 2 percent to 3 percent, and more specifically of less than 1 percent.

The first shrinkable panel 40 and the second shrinkable panel 50 may also be formed from any flexible material that is characterized as a heat shrinkable film, at 90 degrees Celsius. The term "heat shrinkable film at 90 degrees Celsius", as used herein, refers to a film having an unrestrained shrinkage value of greater than 5 percent in at least one direction upon application of heat less than or equal to 90 degrees Celsius. For example, the first shrinkable panel 40 and the second shrinkable panel 50 each may have an unrestrained shrinkage value in the MD or the TD in a range of greater than 5 percent to 20 percent; for example, greater than 6 percent, greater than 7 percent, greater than 8 percent, greater than 9 percent, greater than 10 percent, greater than 11 percent, greater than 12 percent, greater than 13 percent, greater than 14 percent, greater than 15 percent, greater than 16 percent, greater than 17 percent, greater than 18 percent, greater than 19, and no greater than 20 percent.

Figure 1B:
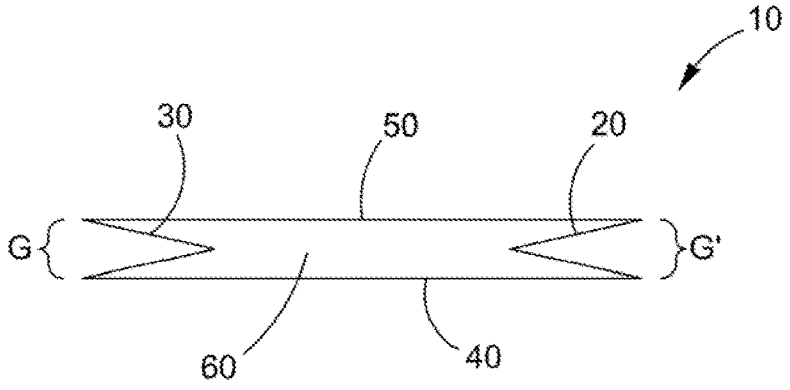
FIG. 1B illustrates a cross-sectional view of the package of FIG. 1A before the gussets are expanded.

The first non-shrinkable panel 20 is opposite to the second non-shrinkable panel 30. The first shrinkable panel 40 is opposite to the second shrinkable panel 50. The first non-shrinkable panel 20, the second non-shrinkable panel 30, the first shrinkable panel 40, and the second shrinkable panel 50 are conjoined along respectively mutual adjacent edges in the longitudinal direction L that forms panel seals 15 to provide a generally rectangular or square shaped bag 10. The first non-shrinkable panel 20 and the second non-shrinkable panel 30 each function as a gusset G and respectively, and are shown in an unfolded configuration in FIG. 1A. FIG. 1B is a cross-sectional view of the bag 10 of FIG. 1A through the plane B-B before the gussets G and G' are completely unfolded.

Figure 1C:
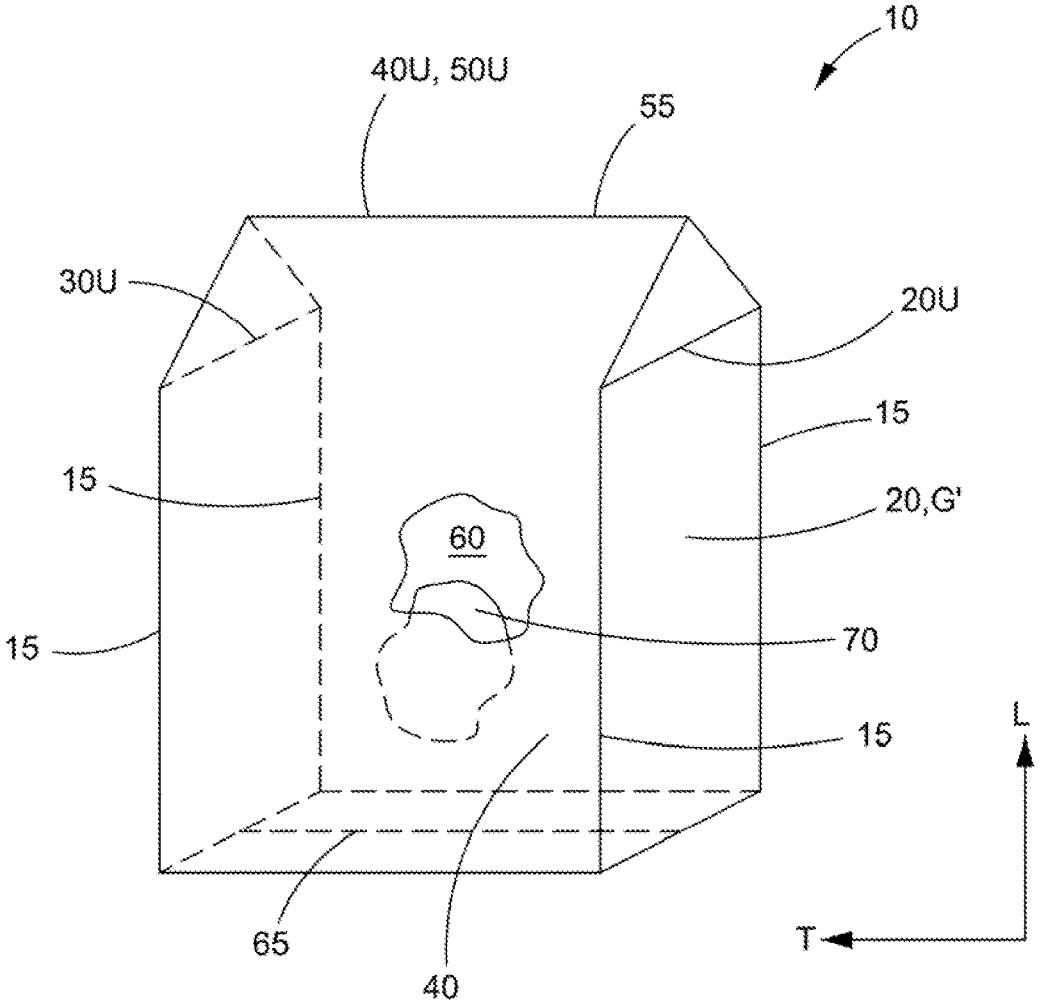
FIG. 1C illustrates a perspective view of an embodiment of the disclosed package.

The bag 10 further includes a first seal 55. In various embodiments, the first seal 55 is positioned in the transverse direction T and may be at, near or towards 1) the first upper edge of the first non-shrinkable panel 20U and the first upper edge of the second non-shrinkable panel 30U, 2) the first upper edge of the first shrinkable panel 40U and the first upper edge of the second shrinkable panel 50U, or 3) the first upper edge of the first non-shrinkable panel 20U, the first upper edge of the second non-shrinkable panel 30U, the first upper edge of the first shrinkable panel 40U, and the first upper edge of the second shrinkable panel 50U. In an embodiment shown in FIG. 1C, the first seal 55 may be positioned at or near the first upper edge of the first shrinkable panel 40U and the first upper edge of the second shrinkable panel 50U. In the embodiment illustrated in FIG. 1C, the first upper edge of the first non-shrinkable panel 20U and the first upper edge of the second non-shrinkable panel 30U are not included in the first seal 55 because the lengths (the distance between the first upper edges 20U and 30U and the second lower edges 20L and 30L) of the first and second non-shrinkable panels 20 and 30 are less than the lengths (the distance between the first upper edges 40U and 50U and the second lower edges 40L and 50L) of the first and second shrinkable panels 40 and 50.

The bag 10 includes a second seal 65. The second seal 65 connects the second lower edges 20L, 30L, 40L or 50L, or an area near the second lower edges 20L, 30L, 40L, or 50L. The second seal 65 encloses the bag 10 to provide an inner compartment 60 to contain products 70. After the inner compartment 60 is filled with products 70 and sealed by the second seal 65, the bag 10 can form a flat bottom. The second seal 65 may be, but is not limited to being a pinch bottom seal or a pinch, fold-over and glue seal as is known by one skilled in the art. The term "inner compartment", as used herein, refers to an interior section of the bag 10 that is configured to hold an item(s) 70 to be packaged in the bag 10. The bag 10 may be referred to as a quad seal bag 10, a side gusset bag 10 or a quattro seal bag 10 as is known by one skilled in the art.

Figure 2A:
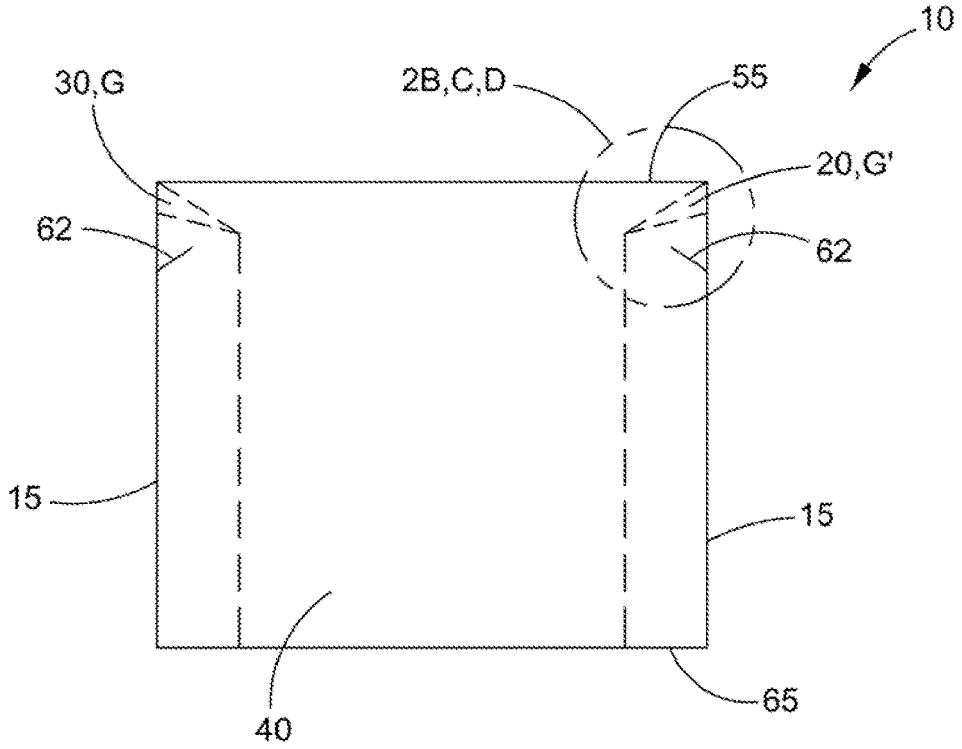
FIGS. 2A-2B illustrate plan views of the disclosed package in a non-filled, flat configuration.
Figure 2B:
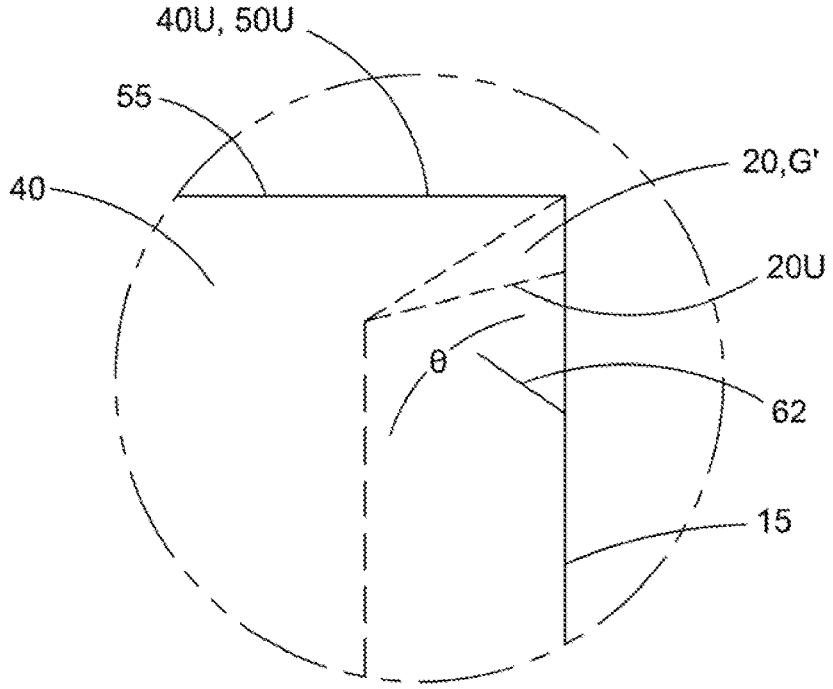

With reference to FIG. 2A, the bag 10 is shown in a flat, unfilled configuration with the gussets G and G' in a folded configuration. In this embodiment, the first seal 55 includes only the first and second shrinkable panels 40 and 50 along the first upper edges of the first and second shrinkable panels 40U and 50U. Further, the first and second non-shrinkable panels 20 and 30 each include two gusset seals 62. One gusset seal 62 connects the first non-shrinkable panel 20 to the first shrinkable panel 40 and another gusset seal 62 connects the first non-shrinkable panel 20 to the second shrinkable panel 50. Two more gusset seals 62 connect the second non-shrinkable panel 30 to the first and second shrinkable panels 40 and 50 in similar fashion to the gusset seals 62 associated with the first non-shrinkable panel 20. With reference to FIG. 2B, a gusset seal 62 that connects the first non-shrinkable panel 20 to the first shrinkable panel 40 is shown. It should be understood that while one gusset seal 62 is described with respect to the first non-shrinkable panel 20, the aspects described herein apply to all gusset seals 62 that may be included with the bag 10. With reference to FIG. 2B, a partial view of the bag 10 that is shown in FIG. 2A illustrates the placement of one of the gusset seals 62. The gusset seal 62 extends from the panel seal 15 of the first non-shrinkable panel 20 and the first shrinkable panel 40 towards the first seal 55 at an angle Θ that is in a range of greater than 0 degrees to less than 90 degrees from the panel seal 15. The gusset seal 62 may have a length that includes the distance from the panel seal 15 to the first upper edge of the first non-shrinkable panel 20U that is nearest the first seal 55 or any length in between. For example, in an embodiment, the gusset seal 62 may be at a 45 degree angle having a length that extends part of the distance from the panel seal 15 to the first upper edge of the first non-shrinkable panel 20U that is nearest the first seal 55. In another embodiment, the gusset seal 62 may be at a 45 degree angle having a length that extends the distance from the panel seal 15 to the first upper edge of the first non-shrinkable panel 20U that is nearest the first seal 55. The gusset seals 62 may be placed in the longitudinal direction L along the panel seals 15 at any point. The bag 10 may include gusset seals 62 in order to provide a fitted appearance or configuration around the items 70 when the items 70 are placed in the inner compartment 60.

It should be understood that the panel seals 15, the first seal 55, the second seal 65, and the gusset seals 62 may be ultrasonic seals, heat seals, pressure seals or any other seal known in the art.

Figure 3:
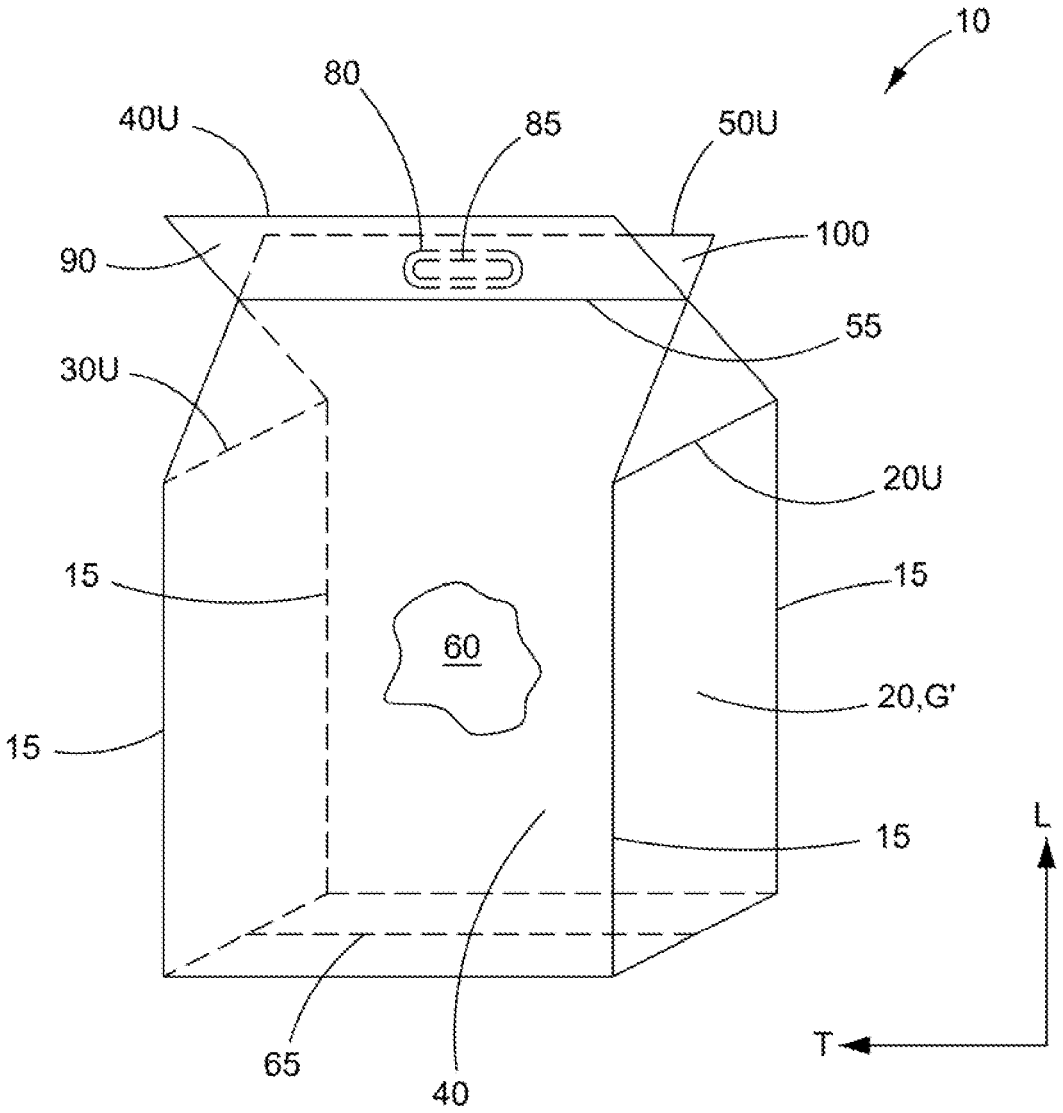
FIG. 3 illustrates a perspective view of an embodiment of the disclosed package.

Another embodiment of the bag 10 is illustrated in FIG. 3 where the gussets G and G' are shown in an unfolded configuration. The bag 10 may further include a first extension 90 of the first shrinkable panel 40 and a second extension 100 of the second shrinkable panel 50. The first extension 90 and the second extension 100 result from the first seal 55 being placed away from the first upper edges of the first and second shrinkable panels 40U and 50U towards the second lower edges of the first and second shrinkable panels 40L and 50L. In this embodiment, the first shrinkable panel 40 and the second shrinkable panel 50 are included in the first seal 55. In other embodiments that include a first extension 90 and a second extension 100, the first seal 55 may include the first non-shrinkable panel 20 and the second non-shrinkable panel 30, or may include the first shrinkable panel 40, the second shrinkable panel 50, the first non-shrinkable panel 20 and the second non-shrinkable panel 30.

Further, the first extension 90 and the second extension 100 may include a first handle forming line of weakness 80 in the first extension 90 and a second handle forming line of weakness 85 in the second extension 100. In an embodiment, the position of each handle forming line of weakness 80 or 85 in the longitudinal direction L is at an equal distance between the first seal 55 and the first upper edges of the first shrinkable panel 40 and the second shrinkable panel 50. The position of the first and second handle forming lines of weakness 80 and 85 along the transverse direction T is at an equal distance between the panel seals 15 that connect the first shrinkable panel 40 and the second shrinkable panel 50 to the first non-shrinkable panel 20 and the second non-shrinkable panel 30. The handle forming lines of weakness 80 and 85 form a perimeter wherein upon removal of the material from within the perimeter a first handle opening and a second handle opening may be formed.

In another embodiment, the first and second handle forming lines of weakness 80 and 85 may form an unenclosed shape that does not form a complete perimeter. In this embodiment, the handle openings may alternatively be formed by breaking the first and second lines of weakness 80 and 85 such that the film is folded back onto itself to form a first handle opening and a second handle opening.

The first and second handle forming lines of weakness 80 and 85 may be formed with perforations, score lines, laser cuts, or any other cutting or scoring method that is known in the art. In an embodiment, the bag 10 may have multiple handle openings, for example to form openings for individual fingers. The first extension 90 and the second extension 100 may be connected to each other with adhesive, ultrasonic seals, heat seals, pressure seals or any other seals known in the art to provide, for example, ease of handling and/or neater appearance.

Figure 4:
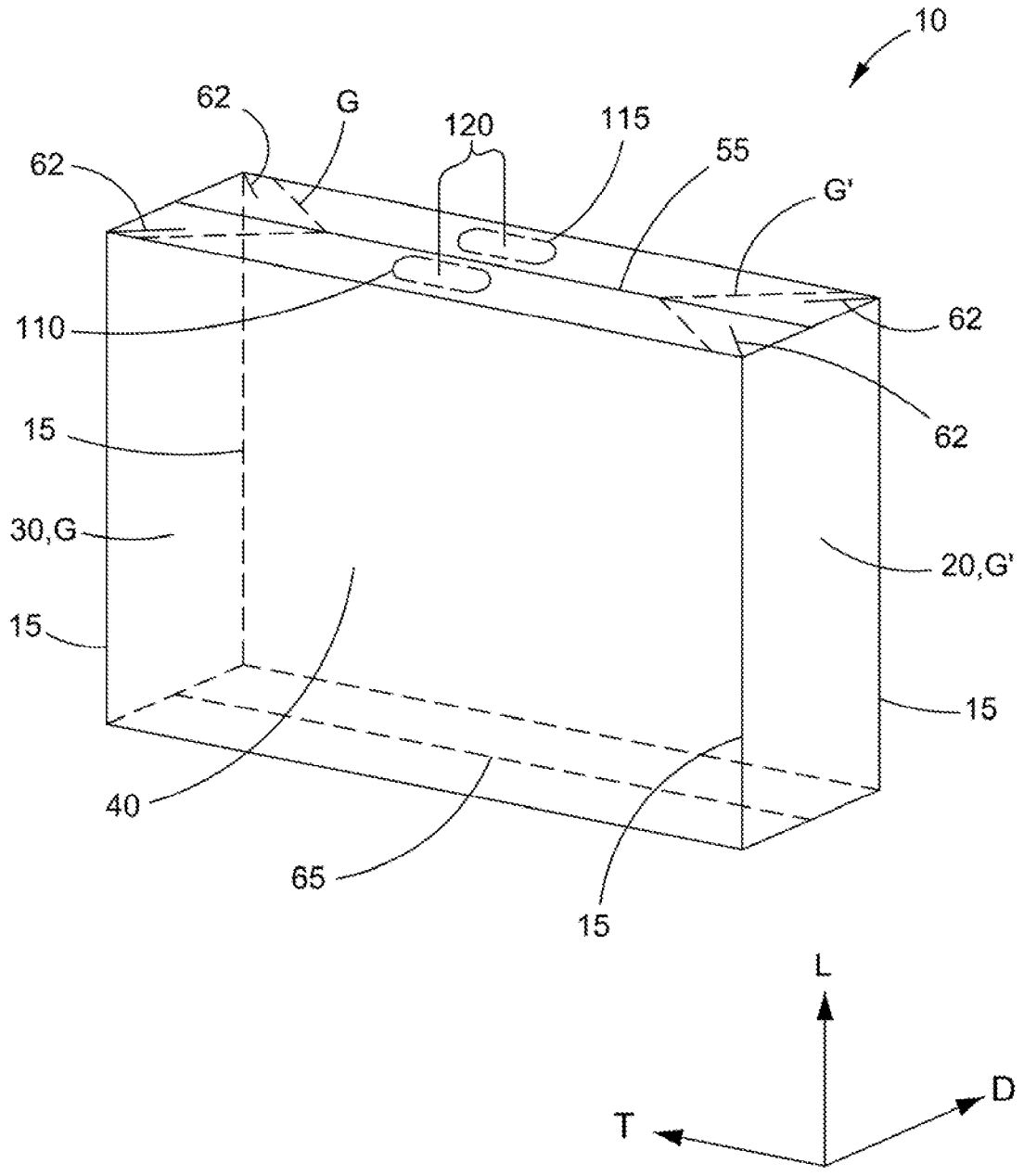
FIG. 4 illustrates a perspective view of an embodiment of the disclosed package.

With reference to FIG. 4, another embodiment of the bag 10 is illustrated where the gussets G and G' are shown in an unfolded configuration. The first seal 55 includes the first and second shrinkable panels 40 and 50 at the first upper edges of the first and second shrinkable panels 40U and 50U. The bag 10 includes four gusset seals 62. Each gusset seal 62 extends from each panel seal 15 towards the first seal at a 45 degree angle. The length of each gusset seal 62 is less than the full distance from the panel seal 15 to the first upper edges of the first and second non-shrinkable panels 20U and 30U. The first shrinkable panel 40 includes a third handle forming line of weakness 110. The second shrinkable panel 50 includes a fourth handle forming line of weakness 115. The third handle forming line of weakness 110 can create a third handle opening and the fourth handle forming line of weakness 115 can create a fourth handle opening in the same manner that has been previously described for the formation of the first handle opening and the fourth handle opening. The third and fourth handle forming lines of weakness 110 and 115 are positioned equidistantly between the panel seals 15 in the transverse direction. T. The position of the third and fourth handle forming lines of weakness 110 and 115 in the depth direction D are such that there is a separation 120 in the range of 24.5 cm to 147 cm (1 inch to 6 inches) of distance between the third and fourth handle forming lines of weakness 110 and 115.

Figure 5:
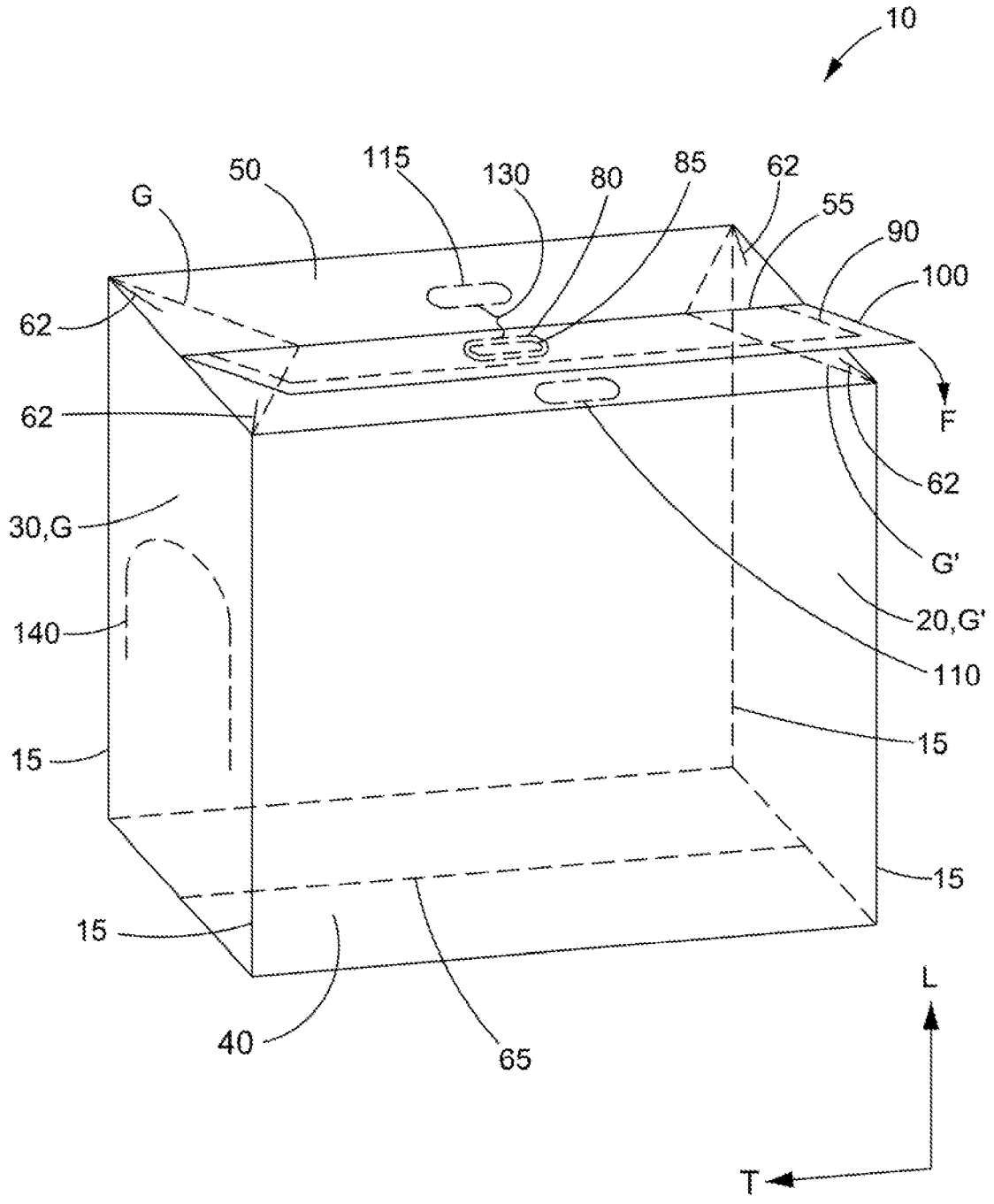
FIG. 5 illustrates a perspective view of an embodiment of the disclosed package.

With reference to FIG. 5, an embodiment of the bag 10 is shown where the gussets G and G' are in an unfolded configuration and with a first extension 90 and a second extension 100. The first extension 90 may include a first handle forming line of weakness 80 and the second extension 100 may include a second handle forming line of weakness 85. The placement of the first and second handle forming lines of weakness 80 and 85 should correspond to the third and fourth handle forming lines of weakness 110 and 115 when the first and second extension 90 and 100 are folded towards the first and/or second shrinkable panels 40 and/or 50. The first extension 90 and the second extension 100 can be folded from the first seal 55 towards either the first shrinkable panel 40 or the second shrinkable panel 50 and can be attached to the respective shrinkable panel 40 or 50. As shown in FIG. 5, the first extension 90 and the second extension 100 are being folded towards the first shrinkable panel 40 as shown by arrow F. Further, the first extension 90 may be attached to the second extension 100 and both extensions 90 and 100 may be attached to the first shrinkable panel 40.

In another embodiment, the first extension 90 can be folded towards the first shrinkable panel 40 and the second extension 100 can be folded towards the second shrinkable extension 50; each extension 90 and 100 may be attached to the respective shrinkable panel 40 and 50. The means of attachment may include adhesive, ultrasonic seals, heat seals, pressure seals or any other seals known in the art. The purpose of attaching the first and second panel extensions 90 and 100 to the first shrinkable panel 40 and/or the second shrinkable panel 50 is to provide a reinforced area 130 of the film between the first and second handle openings and the third or fourth handle openings. The reinforced area 130 provides more material in the area where a user will grip or lift the bag 10 leading towards a better hand feel and strength especially when the bag 10 contains heavy items 70.

The bag 10 may contain individual items 70, such as, but not limited to cans, bottles, boxes, etc. The bag 10 may alternatively include bulk items. Non-limiting examples of bulk items include livestock feed, pet food, cat litter, grass seed, fertilizer, landscaping stones, water softener pellets, etc. It should be understood that in embodiments where the first seal 55 only includes the first shrinkable panel 40 and the second shrinkable panel 50, bulk items may be enclosed in a film overwrap forming a pillow pack type of package that would be contained within the bag 10 since an open area is created near the first upper edges of the first and second non-shrinkable panels 20U and 30U. The bag 10 is intended to contain items 70 where the total weight of the bag 10 and its contents is 27 kg (60 pounds) or less. For example, the bag 10 and its contents should include a weight that is reasonable for a person to carry as they are lifting, holding or carrying the bag 10 by the handle openings. The bag 10 and its contents may weigh 0.5 kg, 1 kg, 2 kg, 3 kg, 4 kg, 5 kg, 6 kg, 7 kg, 8 kg, 9 kg, 10 kg, 11 kg, 12 kg, 13 kg, 14 kg, 15 kg, 16 kg, 17 kg, 18 kg, 19 kg, 20 kg, 21 kg, 22 kg, 23 kg, 24 kg, 25 kg, 26 kg, or 27 kg.

The first non-shrinkable panel 20, the second non-shrinkable panel 30, the first shrinkable panel 40, and second shrinkable panel 50 may have any length and width to form a bag 10 of any desired size to accommodate the items 70 contained therein. The width and length of the first and second shrinkable panels 40 and 50 should be based on the after-shrink dimensions of the shrinkable film that is being used for the first and second shrinkable panels 40 and 50. The combination of the first and second non-shrinkable panels 20 and 30 and the first and second shrinkable panels 40 and 50 in bag 10 should securely hold the items 70 while providing an aesthetically pleasing package. For example, the bag 10 is essentially form-fitted to the items 70 and the inner compartment 60 is devoid of excess film that is loose or floppy around the items 70.

The bag 10 may include an opening feature 140 in the first non-shrinkable panel 20, the second non-shrinkable panel 30 or a combination of the first and second non-shrinkable panels 20 and 30. The opening feature 140 may be formed with perforations, score lines, laser cuts, or any other cutting or scoring method that is known in the art. The opening feature 140 may be shaped in a way that is conducive to removing the items 70 from the bag 10 without difficulty. Further, the opening feature 140 may be shaped in such a way that the opening feature does not include a closed perimeter such that when the opening feature 140 is opened from the respective first or second non-shrinkable panel 20 or 30, waste or garbage is not created. In a "no waste"

embodiment, the opening feature 140 allows the non-shrinkable panel material to be broken or torn from the first or second non-shrinkable panel 20 or 30 at the perforations, score lines, etc., to form an opening while the portion of the broken or torn non-shrinkable film remains attached to the first or second non-shrinkable panel 20 or 30. The opening feature 140 may be placed in the first shrinkable panel 40 and/or the second shrinkable panel 50. However, when the opening feature 140 is located in the first and/or second non-shrinkable panels 40 and/or 50, the perforations, score lines, laser cuts, etc. will not warp when exposed to heat and will tear as expected.

The bag 10 can be used to contain and carry items 70 such as a beverage can 170 or a plurality of beverage cans 170. For example, the bag 10 could be used to carry 6, 12, 15, 24, or 30 beverage cans 170, which are common counts for current paperboard cartons or packages that contain beverage cans 170. The bag 10 can provide a neat-looking package on the store shelf due to the fitted appearance of the bag 10 around the beverage cans 170. The bag 10 also allows for the ability to have graphics printed on the first and second non-shrinkable panels 20 and 30 and/or the first and second shrinkable panels 40 and 50 without any seams or other seals interrupting the face of any of the panels 20, 30, 40, or 50.

In an embodiment that is shown in FIG. 8A, a bag 310 is illustrated to show the gussets G and G' in an unfolded configuration and the bag 310 includes beverage cans 170. The bag 310 includes a first non-shrinkable panel 220, a second non-shrinkable panel 230, a first shrinkable panel 240 and a second shrinkable panel 250. The bag 310 includes four panel seals 215, four gusset seals 262, a first seal 255, and a second seal 265. The first seal 255 includes the first and second shrinkable panels 240 and 250 near the upper edges of the first and second shrinkable panels 240 and 250. The bag 310 includes a first handle opening 282 in the first shrinkable panel 240 and a corresponding second handle opening 287 in the second shrinkable panel 250. The first and second handle openings 282 and 287 are positioned to correspond with each other. The first and second handle openings 282 and 287 are positioned in the longitudinal direction L between the first seal 255 and the first upper edges of the first and second shrinkable panels 240 and 250. The first and second handle openings 282 and 287 are positioned in the transverse direction T between the panel seals 215 of the first and second shrinkable panels 240 and 250. The gusset seals 262 allow the bag 310 to form a top panel 295 when filled with the beverage cans 170 such that the first seal 255 is positioned in the center of the top panel 295 and between the first and second handle openings 282 and 287. The bag 310 includes an opening feature 340 that includes a first opening portion 342 and a second opening portion 347. When the bag 310 is oriented in the configuration shown in FIG. 6A, the first opening portion 342 may opened by pulling upwardly in the longitudinal direction L that allows a user to remove individual beverage cans 170 easily, for example, when the bag 310 is stored in a refrigerator. The second opening portion 347 may be opened by pulling downwardly in the longitudinal direction L that allows a user to remove several beverage cans 170 very quickly by being able to essentially pour the beverage cans 170 from the inner compartment 260, for example into a portable cooler or ice chest.

In another embodiment that is not shown, the bag 310 may include a first extension and a second extension. A third handle opening and a fourth handle opening may be respectively located in the first extension and the second extension. The third handle opening and the fourth handle opening are positioned such that they correspond to the first handle opening 282 when the first extension and the second extension are folded towards the first shrinkable panel 240 from the first seal 255. The first and second extensions may be attached to the first shrinkable panel 240. A reinforced area is located in the top panel 295.

Figure 6A:
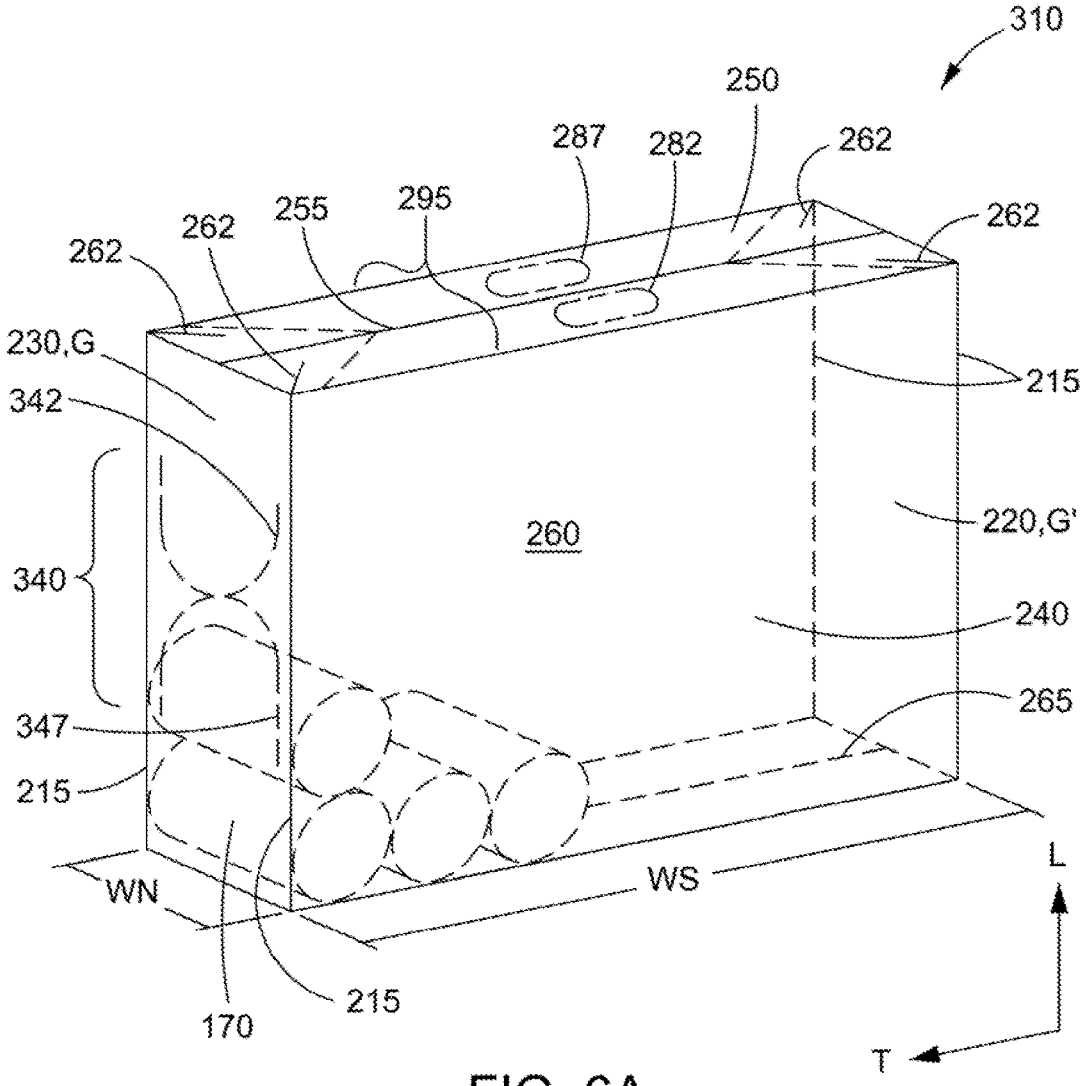
FIG. 6A illustrates a perspective view of an embodiment of the disclosed package.
Figure 6B:
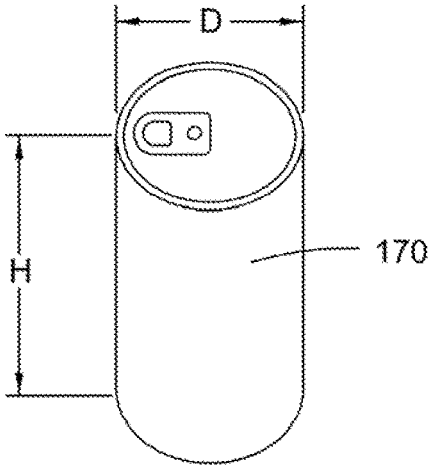
FIG. 6B illustrates a perspective view of a beverage can.

With reference to FIG. 6A, a plurality of beverage cans 170 is shown in the inner compartment 260 of the bag 310. With reference to FIG. 6B, each beverage can 170 includes a diameter D and a height H. For a bag 310, where the beverage can 170 is packaged such that the height H of the beverage can 170 is oriented between the first shrinkable panel 240 and the second shrinkable panel 250. The width WN of the first and second non-shrinkable panels 220 and 230 is approximately equal to the height H of the beverage can 170. The after-shrink width WS of each the first shrinkable panel 240 and the second shrinkable panel 250 is approximately equal to the sum of the diameter D of each beverage can 170 that is placed next to each other in the X direction.

Each and every document cited in this present application, including any cross referenced or related patent or application, is incorporated in this present application in its entirety by this reference, unless expressly excluded or otherwise limited. The citation of any document is not an admission that it is prior art with respect to any embodiment disclosed in this present application or that it alone, or in any combination with any other reference or references, teaches, suggests, or discloses any such embodiment. Further, to the extent that any meaning or definition of a term in this present application conflicts with any meaning or definition of the same term in a document incorporated by reference, the meaning or definition assigned to that term in this present application governs.

Unless otherwise indicated, all numbers expressing sizes, amounts, ranges, limits, and physical and other properties used in the present application are to be understood as being preceded in all instances by the term "about". Accordingly, unless expressly indicated to the contrary, the numerical parameters set forth in the present application are approximations that can vary depending on the desired properties sought to be obtained by a person of ordinary skill in the art without undue experimentation using the teachings disclosed in the present application.

The description, examples, embodiments, and drawings disclosed are illustrative only and should not be interpreted as limiting. The present invention includes the description, examples, embodiments, and drawings disclosed; but it is not limited to such description, examples, embodiments, or drawings. As briefly described above, the reader should assume that features of one disclosed embodiment can also be applied to all other disclosed embodiments, unless expressly indicated to the contrary. Modifications and other embodiments will be apparent to a person of ordinary skill in the packaging arts, and all such modifications and other embodiments are intended and deemed to be within the scope of the present invention.

What is claimed is:

1. A thermoplastic flexible package comprising:

a first non-shrinkable panel and an opposing second non-shrinkable panel;

a first shrinkable panel and an opposing second shrinkable panel;

a panel seal connecting each the first non-shrinkable panel to the first shrinkable panel, the first non-shrinkable panel to the second shrinkable panel, the second non-shrinkable panel to the first shrinkable panel and the second non-shrinkable panel to the second shrinkable panel;

a first seal connecting the first shrinkable panel and the second shrinkable panel; and a second seal opposing the first seal that connects the first and second non-shrinkable panels and the first and second shrinkable panels;

wherein the first and second non-shrinkable panels and the first and second shrinkable panels each include a first longitudinal edge that opposes a second longitudinal edge and each panel includes a first upper transverse edge that opposes a second lower transverse edge, wherein the first non-shrinkable panel and the second non-shrinkable panel oppose each other such that the first upper transverse edges and the second lower transverse edges correspond with each other, wherein the first shrinkable panel and the second shrinkable panel oppose each other such that the first upper transverse edges and the second lower transverse edges correspond with each other, wherein the panel seals connect the longitudinal edges of the first and second non-shrinkable panels to the first and second shrinkable panels, wherein the first non-shrinkable panel and the second non-shrinkable panel each forms a gusset, and wherein the second seal includes the second lower transverse edges of the first and second non-shrinkable panels and the first and second shrinkable panels.

2. The thermoplastic flexible package of claim 1, further comprising a first handle perimeter in the first shrinkable panel positioned between the first seal and the upper edge of the first shrinkable panel and a second handle perimeter in the second shrinkable panel that corresponds to the first handle perimeter.

3. The thermoplastic flexible package of claim 1, further comprising a first extension and a second extension that each extend longitudinally away from the first seal, wherein the first extension includes a first handle perimeter and the second extension includes a second handle perimeter that corresponds to the first handle perimeter, and wherein the first handle perimeter and the second handle perimeter correspond to a third handle perimeter and a fourth handle perimeter when the first extension and the second extension are folded at the first seal toward either the first shrinkable panel or the second shrinkable panel.

4. The thermoplastic flexible package of claim 3, wherein the first extension and the second extension can be attached to either the first shrinkable panel or the second shrinkable panel.

5. The thermoplastic flexible package of claim 1, wherein the first shrinkable panel and the second shrinkable panel include a free shrink value in the range of greater than 5 percent to 20 percent in each the machine direction and the cross direction of the shrinkable panels.

6. The thermoplastic flexible package of claim 1, wherein the first non-shrinkable panel and the second non-shrinkable panel each include a free shrink value in the range of 0 percent to 5 percent in each the machine direction and the cross direction of the non-shrinkable panels.

7. The thermoplastic flexible package of claim 1, further comprising an opening feature on at least one of the first or second non-shrinkable panels.

8. The thermoplastic flexible package of claim 7, wherein the opening feature comprises a first opening portion and a second opening portion.

9. The thermoplastic flexible package of claim 1, wherein the first non-shrinkable panel and the second non-shrinkable panel are each further sealed to the first shrinkable panel and the second shrinkable panel with a gusset seal wherein the gusset seal extends from the panel seal towards the first seal at an angle from the panel seal in the range of greater than 0 degrees to less than 90 degrees.

10. The thermoplastic flexible package of claim 1, wherein the package can contain at least a beverage can that includes a can height and a can diameter.

11. The thermoplastic flexible package of claim 10, wherein a width of each of the first non-shrinkable panel and the second non-shrinkable panel comprises the can height.

12. The thermoplastic flexible package of claim 10, wherein an after-shrink width of each of the first shrinkable panel and the second shrinkable panel includes the sum of the can diameters for each can that is placed next to each other in the transverse direction.

13. The thermoplastic flexible package of claim 1, wherein the second seal comprises a pinch bottom seal or a pinch, fold-over and glue seal.

* * * * *